US006241512B1

(12) United States Patent
Freeman et al.

(10) Patent No.: US 6,241,512 B1
(45) Date of Patent: Jun. 5, 2001

(54) DECORATIVE CANDLE DISPLAY AND METHOD OF FORMING THE SAME

(76) Inventors: Scott H. Freeman, 3632 Rebel Cir, Huntington Beach, CA (US) 92649; Frank H. Asbury, 144 N. Trevor St., Anaheim, CA (US) 92806

( * ) Notice: Subject to any disclaimer, the term of this patent is extended or adjusted under 35 U.S.C. 154(b) by 0 days.

(21) Appl. No.: 09/493,394

(22) Filed: Jan. 28, 2000

Related U.S. Application Data

(63) Continuation-in-part of application No. 09/337,292, filed on Jun. 21, 1999, now Pat. No. 6,033,210.

(51) Int. Cl.[7] ..... F23D 3/16
(52) U.S. Cl. ..... 431/291; 44/275
(58) Field of Search ..... 431/288, 289, 431/291; 44/275

(56) References Cited

U.S. PATENT DOCUMENTS

| | | | | |
|---|---|---|---|---|
| 2,354,343 | * | 7/1944 | Webber et al. | 431/289 |
| 4,826,428 | * | 5/1989 | Lam | 431/291 |
| 5,395,233 | * | 3/1995 | Karp | 431/289 |
| 6,033,210 | * | 3/2000 | Freeman | 431/291 |
| 6,036,477 | * | 3/2000 | Frandsen | 431/291 |
| 6,171,102 | * | 1/2001 | Freeman et al. | 431/291 |

OTHER PUBLICATIONS

"What is Wax?–Petroleum Wax Manufacturing–Simple Overview"—[Online] [Retrieved 9/1999].
"Candle Making—Waxes"—[Online] [Retrieved 1/1999].
"Homespun Floral Candles", Country living Gardener, Nov./Dec. 1996, pp. 92 and 93.

* cited by examiner

*Primary Examiner*—Sara Clarke
(74) *Attorney, Agent, or Firm*—Stetina Brunda Garred & Brucker

(57) ABSTRACT

A decorative candle display. The display includes a non-opaque container with an interior wall surface and a core candle having a first melting point and situated within the container such that a chamber is formed between the core candle and the wall surface. A plurality of colored gelatinous structures are adhered against the interior wall surface such that the structures are visible exteriorly, and a meltable solid mixture having a second melting point lower than the first melting point is disposed within the chamber. The chamber is of a cross sectional size adequate to dissipate heat through the solid mixture from the core candle when lighted such that the gelatinous structures do not melt from that heat. Concurrently, a cavern is formed within the solid mixture where the core candle is situated and when the core candle is burned. This cavern is formed by minimal melting of surrounding mixture material, and permits a subsequent replacement core candle which is placed in the cavern upon depletion of the original core candle. In this manner, the present decorative candle display can be re-used by simply placing a new core candle, typically a standard votive candle, within the container.

12 Claims, 2 Drawing Sheets

DECORATIVE CANDLE DISPLAY AND METHOD OF FORMING THE SAME

CROSS-REFERENCE TO RELATED APPLICATIONS

This application is a continuation-in-part of U.S. patent application Ser. No. 09/337,292, filed Jun. 21, 1999 is now U.S. Pat. No. 6,033,210.

STATEMENT RE: FEDERALLY SPONSORED RESEARCH/DEVELOPMENT (Not Applicable)

BACKGROUND OF THE INVENTION

The present invention generally relates to decorative candles, and more particularly to a decorative candle display having uniquely shaped, integral gelatinous structures suspended within the display and additionally constructed to accept a replacement core candle upon depletion of an original core candle.

Candles have become popular for decorative purposes and as such are being formed in different styles, shapes, and colors. Typically, there are three different types of candles: tapered, molded, and container. The candles may be manufactured from a wax, such as paraffin, vegetable or beeswax.

A container candle is formed by pouring molten wax into a container having a wick disposed therein. The wick is extensible through the wax such that as the wick is burned, the wax around the wick will melt, thereby providing fuel for the wick to burn. A molded candle is formed by pouring melted wax into a mold containing a wick. The wax is allowed to cool such that it solidifies and is then removable from the mold thereby forming the candle. Tapered candles are formed by dipping a wick into melted wax. Each time the candle is dipped into the melted wax, the wax adheres to itself thereby forming the tapered candle.

Fragrances and/or pigments can be added to the wax to give the candle a unique appearance. Typically, the fragrance and/or pigment is mixed with the wax when in a molten state. The wax containing the fragrance and/or pigment is then formed into the preferred type of candle. The pigment will give the candle a desired coloring, while the fragrance gives the candle a preferred scent. The scent produced by the fragrance may become more pronounced as the candle is being burned.

In addition to making candles out of wax, mineral oil has been used to make candles (i.e., gel candles). The mineral oil is gelatinous and a solid at ambient temperature. Typically, a gel candle is formed by pouring molten mineral oil into a container having a wick. The mineral oil is allowed to cool to its gelatinous state thereby forming a candle within the container. Gel candles burn longer than candles made from paraffin wax because of the high oil content of the gel. Furthermore, gel candles may additionally be scented and/or colored to add more variety to the candles. Additionally, gel components may be fabricated from the mineral oil gel, where the gel components are individual pieces of mineral oil gel fabricated into prescribed shapes. The individual gel components may then be placed on the top of a wax candle to provide a more decorative appearance.

BRIEF SUMMARY OF THE INVENTION

In view of the above considerations, it is apparent that gel structures can provide aesthetic contributions to candle products. Accordingly, a primary object of the present invention is to provide a decorative candle display incorporating a core candle within a non-opaque container and surrounded by a plurality of colored gelatinous structures maintained in place against the container wall by a meltable solid mixture component within a chamber situated between the core candle and the wall.

Another object of the present invention is to provide a decorative candle display wherein the chamber is of a cross sectional size adequate to dissipate heat through the solid mixture from the core candle when lighted such that the gelatinous structures do not melt but, instead, appear as a stained glass.

Yet another object of the present invention is to provide a decorative candle display wherein a cavern is formed within the solid mixture when the core candle is burned and wherein a subsequent replacement core candle can be inserted, thereby permitting re-use of the product.

These and other objects of the present invention will become apparent throughout the description thereof which now follows.

BRIEF SUMMARY OF THE INVENTION

The present invention is a decorative candle display and a method for its manufacture. The candle display comprises a non-opaque container with an interior wall surface and a core candle having a first melting point and situated within the container such that a chamber is formed between the core candle and the wall surface. A plurality of colored gelatinous structures are adhered against the interior wall surface such that the structures are visible exteriorly, and a meltable solid mixture having a second melting point lower than the first melting point is disposed within the chamber. The chamber is of a cross sectional size adequate to dissipate heat through the solid mixture from the core candle when lighted such that the gelatinous structures do not melt from that heat. Concurrently, a cavern is formed within the solid mixture where the core candle is situated and when the core candle is burned. This cavern is formed by minimal melting of surrounding mixture material, and permits a subsequent replacement core candle which is placed in the cavern upon expiration of the original core candle. Finally, upon lighting the replacement core candle, a minimal amount of core-candle wax will melt to fill any excess void between the core candle and the cavern wall formed by the mixture. In this manner, the present decorative candle display can be re-used by simply placing a new core candle, typically a standard votive candle, within the container.

Methodology for manufacturing the decorative candle display comprises the placement of a core candle having a first melting point into a non-opaque container such that a chamber is formed between the core candle and inside wall surface of the container. A plurality of colored gelatinous structures are adhered against the interior wall surface such that these structures are visible exteriorly and are inherently sufficiently tacky to adhere to the surface. A molten mixture having a second melting point lower than the first melting point is then poured into the chamber and allowed to cool and form a solid mixture. Sizing is such that the chamber is of a cross sectional size adequate to dissipate heat through the solid mixture from the core candle when lighted and to form a cavern within the solid mixture as described above for acceptance of a subsequent replacement core candle.

BRIEF DESCRIPTION OF THE DRAWINGS

An illustrative and presently preferred embodiment of the invention is shown in the accompanying drawings in which.

DETAILED DESCRIPTION OF THE PREFERRED EMBODIMENT

Figure 1:
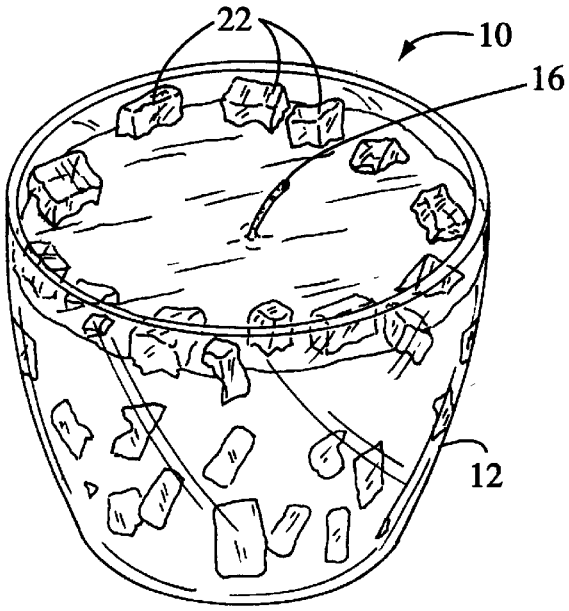
FIG. 1 is a perspective view of a decorative candle display.
Figure 2:
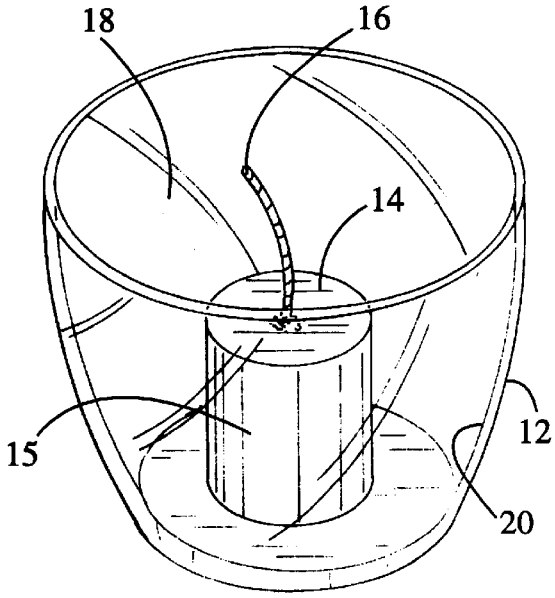
FIG. 2 is a perspective view of a transparent container having therein a core candle.
Figure 3:
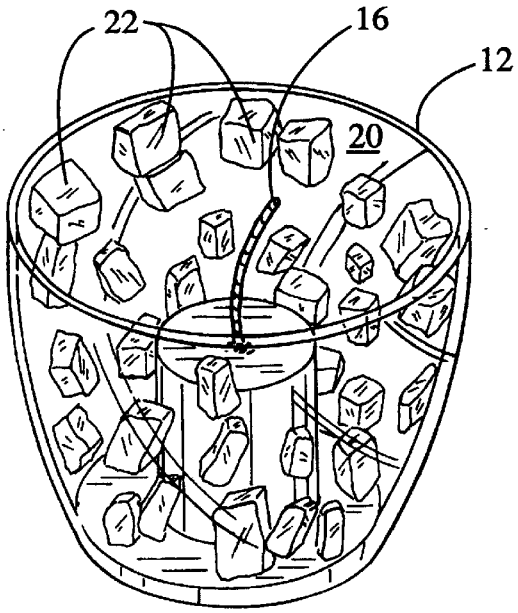
FIG. 3 is a perspective view as in FIG. 2 having therein the core candle and a plurality of colored gelatinous structures adhered against the interior wall surface of the container.

Referring to FIGS. 1–4, a decorative candle display 10 is illustrated. The display 10 includes a transparent container 12 which can be made of glass or other appropriate material, and a core candle 14 disposed within the container 12. The core candle 14 preferably is a conventional paraffin wax votive candle with a wick 16 as known in the art and has a melting temperature between about 125° and 145° F. As clearly shown in FIG. 2, a chamber 18 is formed between the core candle 14 and the interior wall surface 20 of the container 12.

Figure 4:
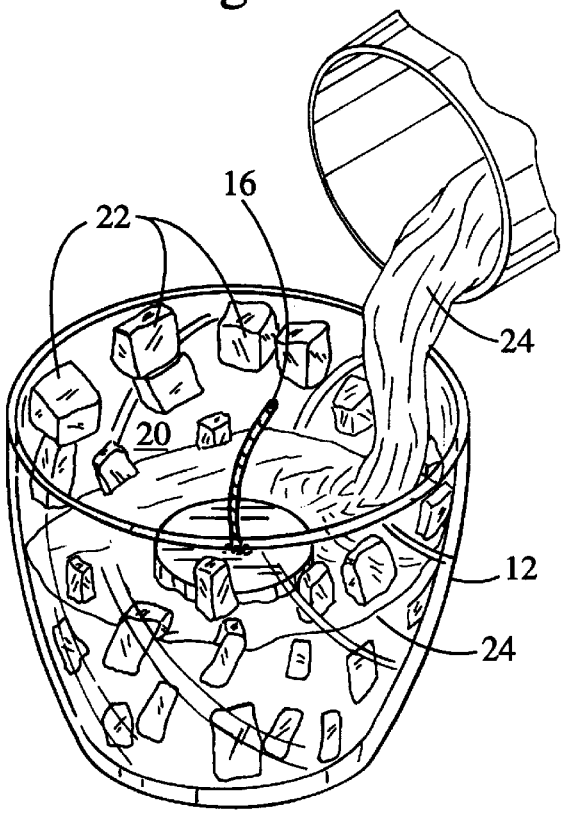
FIG. 4 is a perspective view as in FIG. 3 illustrating the addition thereto of a molten mixture into a chamber formed between the core candle and the interior wall surface.

The display 10 includes a plurality of colored gelatinous structures 22 adhered against the interior wall surface 20 such that the structures 22 are visible from the exterior of the container 12. As here non-limitedly exemplified, the gelatinous structures 22 are cut to be generally cube shaped and are manufactured from a mineral oil gel which is solid, yet also flexible, and sufficiently tacky to inherently adhere to the interior wall surface 20. Such gel products are available as "Candle Gel" and "Versa Gel," both manufactured by Penrico Company, Woodland, Texas. These products can be poured into molds to form desired structures, formed into sheets which can be cut to desired structural configurations, or otherwise conventionally treated to yield shaped end products that function as the gelatinous structures 22. Because the gelatinous structures 22 adhere against the interior wall surface 20 of the container 12, a space exists within the chamber 18 between the gelatinous structures 22 and the surface 15 of the core candle 14. Finally, the candle display 10 additionally includes a petroleum and paraffin mixture 24 within the chamber 18 and introduced therein by pouring in a molten state as illustrated in FIG. 4. The mixture 24 has a melting point below that of the core candle 14 and the gelatinous structures 22 so that neither the core candle 14 or the structures 22 melt when the mixture 24 is so introduced. Once cooled, the mixture 24 surrounds each gelatinous structure 22 and is in contact with the exterior surface 15 of the core candle 14. The mixture 24 can be translucent or colored with pigments, and can include a scent oil as desired.

Figure 5:
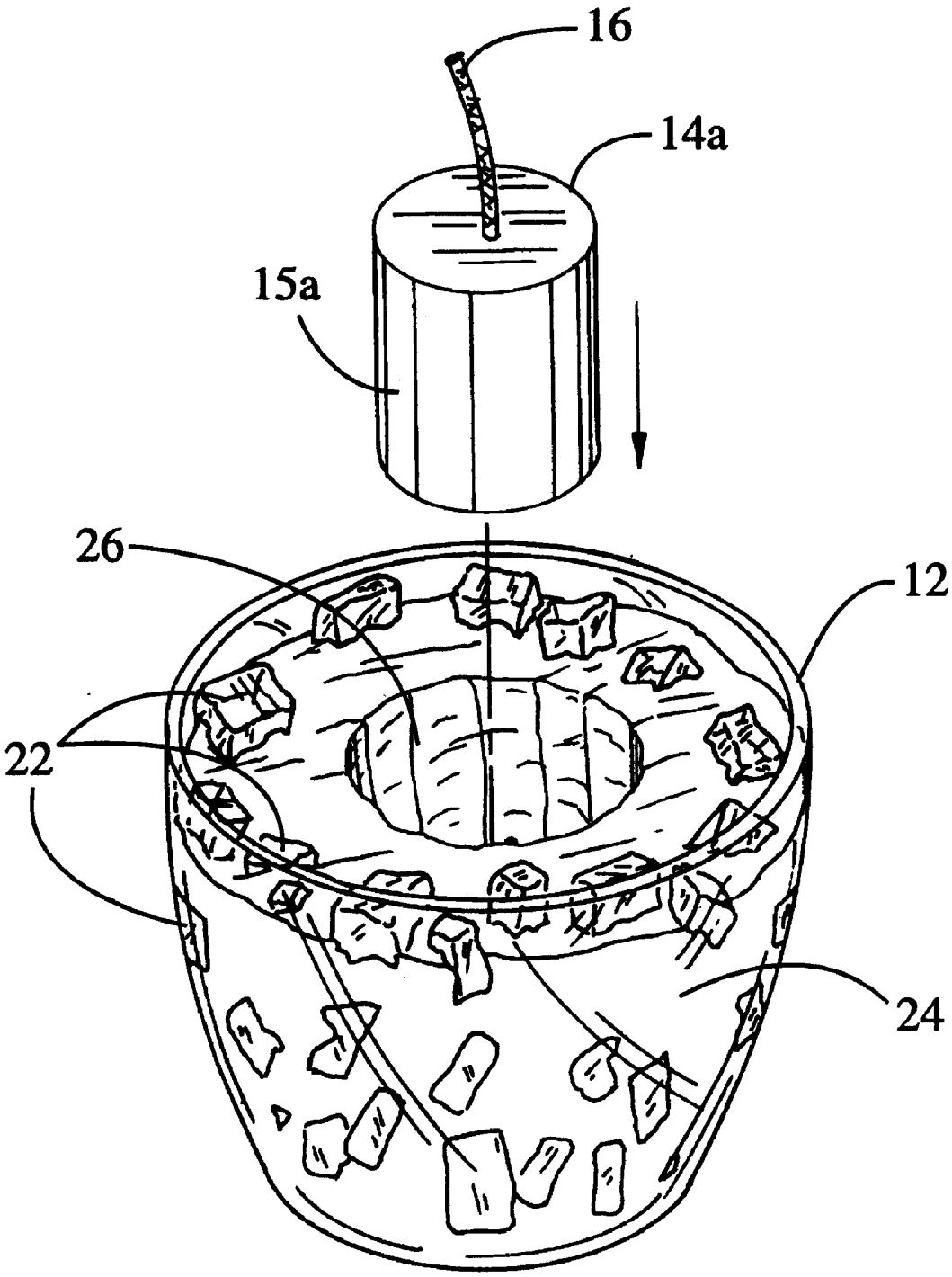
FIG. 5 illustrates the replacement of a core candle within a cavern formed in the place left by an initial core candle after its depletion.

The chamber 18 within which the gelatinous structures 22 and mixture 24 reside is sized to have a cross section adequate to dissipate heat generated by the lighted core candle 14 through the mixture 24 without causing the melting of the gelatinous structures 22. Instead, only a portion of the mixture 24 situated adjacent the surface 15 of the core candle 14 melts during core-candle burning while the gelatinous structures 22 present a stained glass appearance through the container 12 as the flame of the core candle 14 glows there behind. Melting of the portion of the mixture 24 adjacent the core candle surface 15 results in the formation of a cavern 26 within the mixture 24 as illustrated in FIG. 5 such that, when an initial core candle 14 is burned to depletion, the cavern 26 so formed is of a diameter sufficient to easily accept a replacement core candle 14*a* as indicated by the arrow. When the replacement core candle 14*a* is thereafter lighted, its heat once again melts a portion of the mixture 24 adjacent the surface 15*a* thereof to thereby fill in any void between the surface 15*a* of the replacement core candle 14*a* and the mixture 24 itself. As is therefore apparent, a simple replacement of an expended core candle 14 can permit a continuing use of the candle display 10 for a significant period of time.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A decorative candle display comprising:

a) a non-opaque container with an interior wall surface;

b) a core candle situated within the container such that a chamber is formed between the core candle and the wall surface, said core candle having a first melting point;

c) a plurality of colored gelatinous structures adhered against the interior wall surface such that said structures are visible exteriorly;

d) a mixture within the chamber, said mixture having a second melting point lower than the first melting point; and e) with the proviso that the chamber is of a cross sectional size adequate to dissipate heat through said solid mixture from the core candle when lighted such that said gelatinous structures do not melt from said heat and such that a cavern is formed within said solid mixture when said core candle is depleted and wherein a subsequent replacement core candle can be inserted.

2. A decorative candle display as claimed in claim 1 wherein the core candle is formed of a paraffin wax.

3. A decorative candle display as claimed in claim 1 wherein the colored gelatinous structures are formed of a mineral oil gel.

4. A decorative candle display as claimed in claim 1 wherein the mixture the mixture comprises paraffin and petrolatum.

5. A decorative candle display as claimed in claim 4 wherein the mixture additionally comprises a pigment.

6. A decorative candle display as claimed in claim 4 wherein the mixture additionally comprises a fragrance.

7. A method of manufacturing a decorative candle display comprising the steps of:

a) providing a non-opaque container with an interior wall surface;

b) placing a core candle having a first melting point into the container such that a chamber is formed between the core candle and the wall surface;

c) positioning a plurality of colored gelatinous structures against the interior wall surface such that said structures are visible exteriorly, wherein said gel structures are sufficiently tacky to adhere to said surface;

d) pouring a molten mixture into the chamber, said mixture having a second melting point lower than the first melting point, and cooling said mixture to form a solid mixture; and e) with the proviso that the chamber is of a cross sectional size adequate to dissipate heat through said solid mixture from the core candle when lighted such that said gelatinous structures do not melt from said heat and such that a cavern is formed within said solid mixture when said core candle is depleted and wherein a subsequent replacement core candle can be inserted.

8. A method as claimed in claim 7 wherein the core candle is formed of a paraffin wax.

9. A method as claimed in claim 7 wherein the colored gelatinous structures are formed of a mineral oil gel.

10. A method as claimed in claim 7 wherein the mixture comprises paraffin and petrolatum.

11. A method as claimed in claim 10 wherein the mixture additionally comprises a pigment.

12. A method as claimed in claim 10 wherein the mixture additionally comprises a fragrance.

* * * * *